US011493235B2

(12) United States Patent
Wulff et al.

(10) Patent No.: US 11,493,235 B2
(45) Date of Patent: Nov. 8, 2022

(54) ELECTRIC LIQUID HEATER FOR VEHICLES WITH PLUG CONNECTOR INCLUDING VENT DUCT

(71) Applicant: BorgWarner Ludwigsburg GmbH, Ludwigsburg (DE)

(72) Inventors: Nicolaus Wulff, Stuttgart (DE); Sven Schumm, Walheim (DE); Christian Pottiez, Eppingen (DE); Timo Stifel, Freiberg am Neckar (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 8 days.

(21) Appl. No.: 17/022,927

(22) Filed: Sep. 16, 2020

(65) Prior Publication Data

US 2021/0148606 A1 May 20, 2021

(30) Foreign Application Priority Data

Sep. 19, 2019 (DE) ..... 10 2019 125 281.4

(51) Int. Cl.

| | |
|---|---|
| ***F24H 9/20*** | (2022.01) |
| ***F24H 1/10*** | (2022.01) |
| ***F24H 9/02*** | (2006.01) |
| ***F24H 9/1818*** | (2022.01) |

(52) U.S. Cl.

CPC ..... *F24H 9/2028* (2013.01); *F24H 1/102* (2013.01); *F24H 9/02* (2013.01); *F24H 9/1818* (2013.01)

(58) Field of Classification Search

CPC ..... B60H 1/2221; F24H 1/009; F24H 1/121; F24H 9/1827; H05B 2203/02; H05B 2203/021

See application file for complete search history.

(56) References Cited

U.S. PATENT DOCUMENTS

| | | | | |
|---|---|---|---|---|
| 1,939,602 | A * | 12/1933 | Suppes | F24H 3/105 126/116 R |
| 5,484,527 | A | 1/1996 | Janik et al. | |
| 5,489,384 | A | 2/1996 | Janik et al. | |
| 5,525,225 | A | 6/1996 | Janik et al. | |
| 5,614,091 | A | 3/1997 | Janik et al. | |

(Continued)

FOREIGN PATENT DOCUMENTS

| | | |
|---|---|---|
| DE | 356 303 C | 7/1922 |
| DE | 10 2017 121 341 A1 | 3/2019 |

(Continued)

*Primary Examiner* — Edelmira Bosques
*Assistant Examiner* — Michael James Giordano
(74) *Attorney, Agent, or Firm* — Bose McKinney & Evans LLP

(57) ABSTRACT

Described is a liquid heater having a housing, in which a flow channel runs from an inlet to an outlet, a heating resistor arranged within the housing for heating liquid flowing through the flow channel, control electronics which are arranged in an interior space of the housing, the interior space being sealed off from the flow channel, and a plug connector attached to the housing. Provided according to this disclosure, the plug connector has a vent duct which is closed by a membrane and which leads to the interior space sealed against the ingress of liquid, in which interior space the control electronics are arranged.

11 Claims, 4 Drawing Sheets

(56) References Cited

U.S. PATENT DOCUMENTS

| | | | | |
|---|---|---|---|---|
| 2013/0145996 | A1* | 6/2013 | Cooper | F22B 1/1853 122/31.2 |
| 2013/0233509 | A1* | 9/2013 | Schultz | F25B 30/02 165/45 |
| 2019/0077224 | A1 | 3/2019 | McCarthy et al. | |
| 2020/0156443 | A1* | 5/2020 | Ding | F24H 9/1818 |
| 2022/0003455 | A1* | 1/2022 | Lim | F24H 9/1818 |

FOREIGN PATENT DOCUMENTS

| | | | | |
|---|---|---|---|---|
| EP | 0 657 199 | A2 | 6/1995 | |
| WO | WO-2016066601 | A1 * | 5/2016 | H05B 3/262 |

* cited by examiner

ELECTRIC LIQUID HEATER FOR VEHICLES WITH PLUG CONNECTOR INCLUDING VENT DUCT

RELATED APPLICATIONS

This application claims priority to DE 10 2019 125 281.4, filed Sep. 19, 2019, the entire disclosure of which is hereby incorporated herein by reference.

BACKGROUND AND SUMMARY

This disclosure relates to an electrical liquid heater having the features mentioned in the preamble of claim 1. Such a liquid heater is known, for example, from EP 0 657 199 A2.

Liquid heaters are used in motor vehicles for heating various liquids, particularly for heating aqueous liquids. Automobile manufacturers are placing ever increasing demands on installation space, which leads to ever higher power densities.

This disclosure teaches a liquid heater for motor vehicles which is compact and can be operated with high electrical powers.

A liquid heater according to this disclosure has a housing in which a flow channel runs from an inlet to an outlet, a heating resistor arranged within the housing for heating liquid flowing through the flow channel, control electronics arranged in an interior space of the housing, the interior space being sealed off from the flow channel, and a plug connector attached to the housing. The liquid heater according to this disclosure can advantageously be operated as a flow heater with high electrical powers, since the plug connector has a vent duct closed by a membrane, the vent duct leading to the interior space sealed against the ingress of liquid, in which interior space the control electronics are arranged. The air-permeable membrane namely enables pressure equalization between the sealed interior space and the surroundings of the liquid heater. The heating resistor can therefore be heated to higher temperatures, which lead to a considerable rise in temperature in the sealed interior space in which the control electronics are arranged. The air-permeable membrane thereby prevents problematic pressure from building up in the sealed interior space, which pressure could make it difficult to seal off the flow channel.

A liquid heater according to this disclosure can have a plug connector, via which the control electronics can be connected to a voltage source, and a further plug connector for connecting the heating resistor to a voltage source, particularly a high voltage source. It is sufficient when one of these two plug connectors has a vent duct closed by a membrane. A single plug connector is also possible, via which both the control electronics and the heating resistor are supplied.

An advantageous refinement of this disclosure provides that the electrical resistor is likewise arranged in the interior space of the housing, the interior space being sealed off from the flow channel, for example, as a conducting path on a substrate. In this case, the substrate, with its underside facing away from the conducting path, can limit the flow channel, that is, said flow channel can be exposed to the liquid to be heated. The electrical heating resistor can be arranged together with the control electronics in one chamber. However, it is preferred for the heating resistor and the control electronics to be arranged in different chambers which are connected via an air duct. The control electronics can be thermally decoupled from the heating resistor in this way.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

FIGS. 1 to 4 show a liquid heater which can be used as a flow heater for aqueous liquids in motor vehicles. The liquid heater has a housing 1 made of metal, for example, aluminum, in which a flow channel 15 for liquid to be heated runs from an inlet 2 to an outlet 3.

Figure 1:
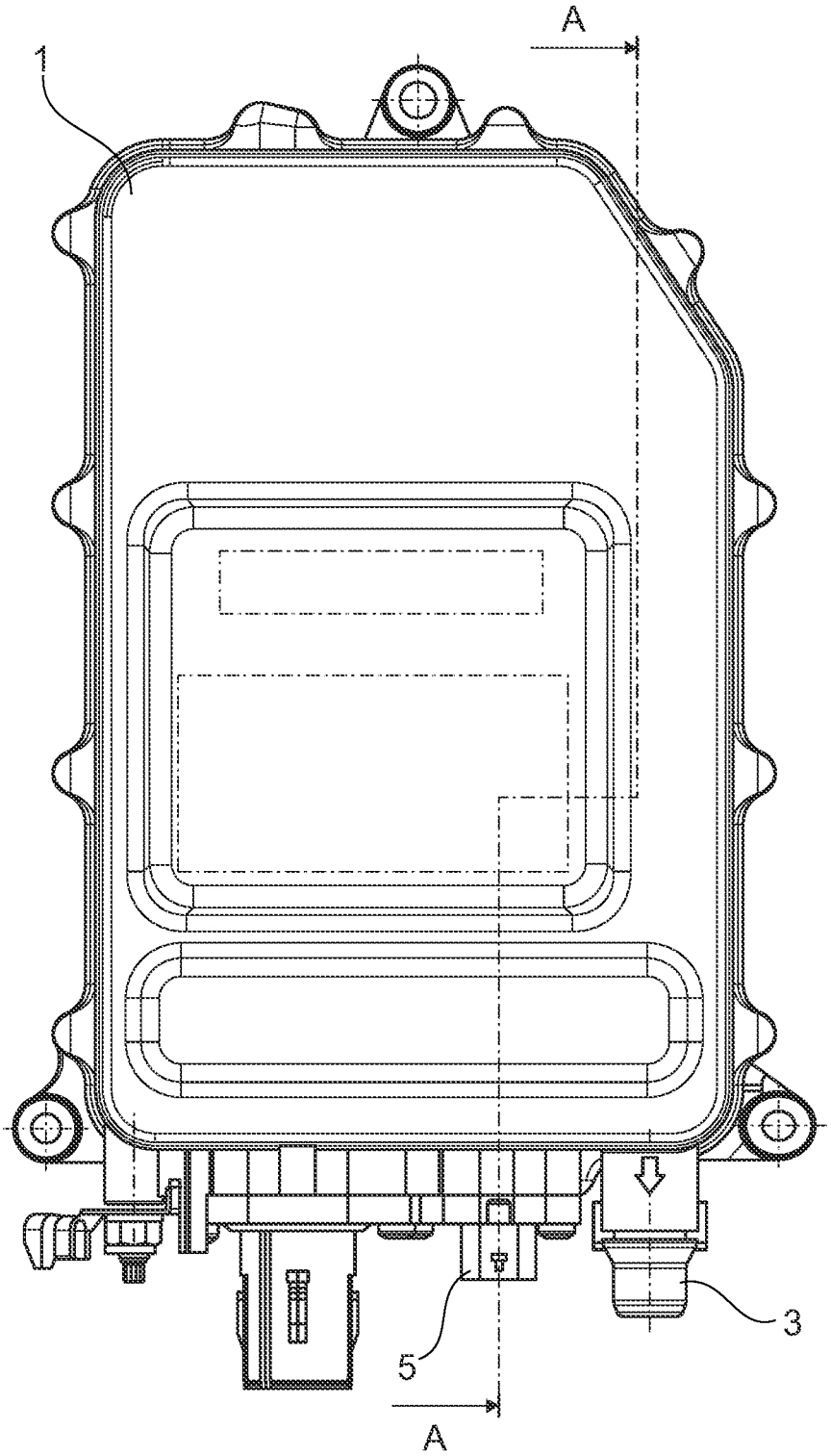
FIG. 1 is an embodiment of a liquid heater according to this disclosure.
Figure 2:
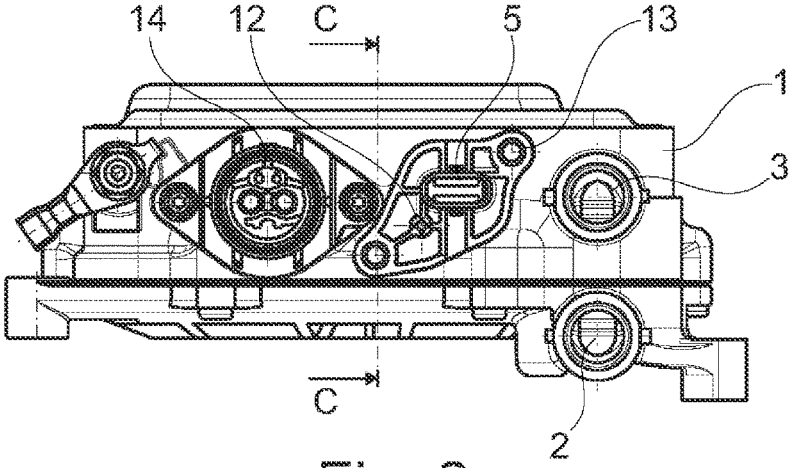
FIG. 2 is a further view of the liquid heater.
Figure 3:
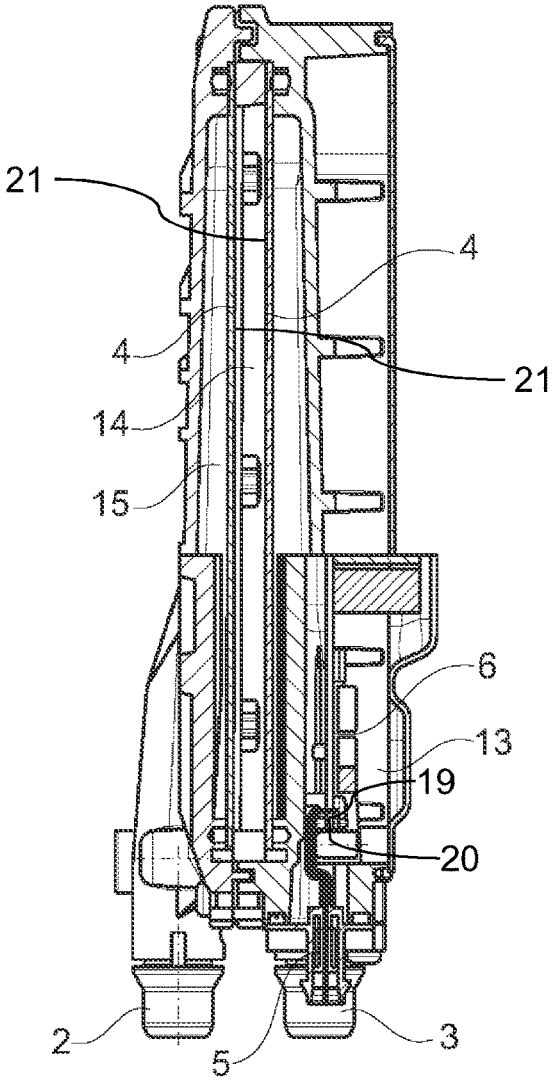
FIG. 3 is a sectional view of FIG. 1 along the section line A-A.
Figure 4:
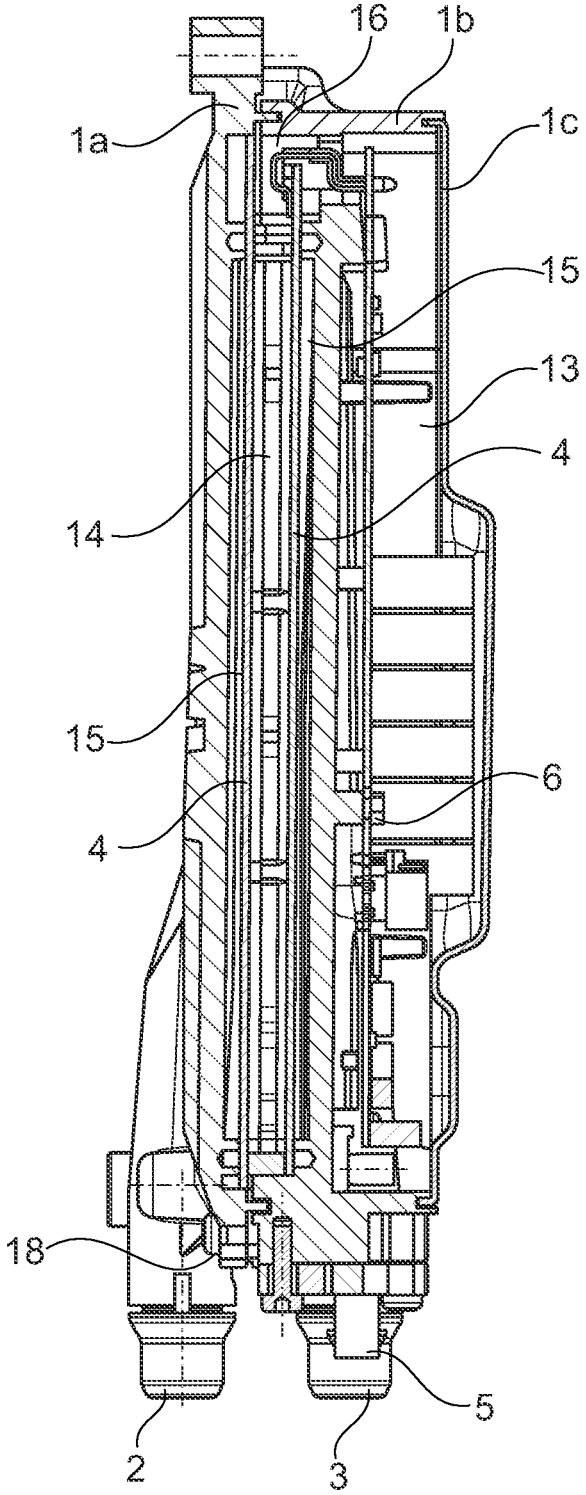
FIG. 4 is a sectional view of FIG. 2 along the section line C-C.

FIG. 3 shows a sectional view of the housing 1 along the angled section line A-A of FIG. 1, FIG. 4 a sectional view of the housing 1 along the angled section line C-C of FIG. 2. In the embodiment shown, the housing 1 has two housing parts 1*a*, 1*b*, which are connected to one another by screws 18 and enclose the flow channel 15 between them, and a housing cover 1*c*.

One or more electrical heating resistors are arranged in the housing 1. In the embodiment shown, a plurality of heating resistors is provided as conducting paths 21 on a substrate, for example, a metal sheet covered with an insulator layer, e.g. a dielectric. Together with the substrate, these conducting paths form heating plates 4. In the exemplary embodiment shown, the heating plates 4 limit a flow channel 15 in the housing 1 for the liquid to be heated. The conducting paths 21 and thus the electrical heating resistors are arranged on a side of the substrate facing away from the flow channel 15, that is, they are located on a dry side of the heating plates 4 and thus in a chamber 14 in the housing 1, the chamber being sealed off from the flow channel 15.

The energization of the heating resistor(s) is controlled by control electronics 6 also arranged in the housing 1. The control electronics 6 comprise a circuit board with circuit elements, particularly transistor switches, which are arranged in an interior space of the housing 1, the interior space being sealed off from the flow channel 15. The chamber 14, in which the heating resistors are arranged, can be part of this interior space, for example, by being connected to it by an air duct 16. In the exemplary embodiment shown, the control electronics 6 and the heating resistors are arranged in different chambers 13, 14 connected by an air duct 16, so that the control electronics 6 are thermally decoupled from the heating resistors, but pressure equalization via the air duct 16 is possible.

Figure 5:
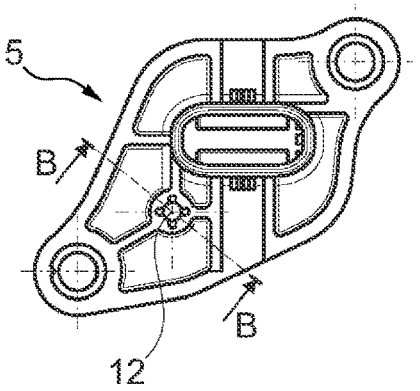
FIG. 5 is the plug connector of the water heater.
Figure 6:
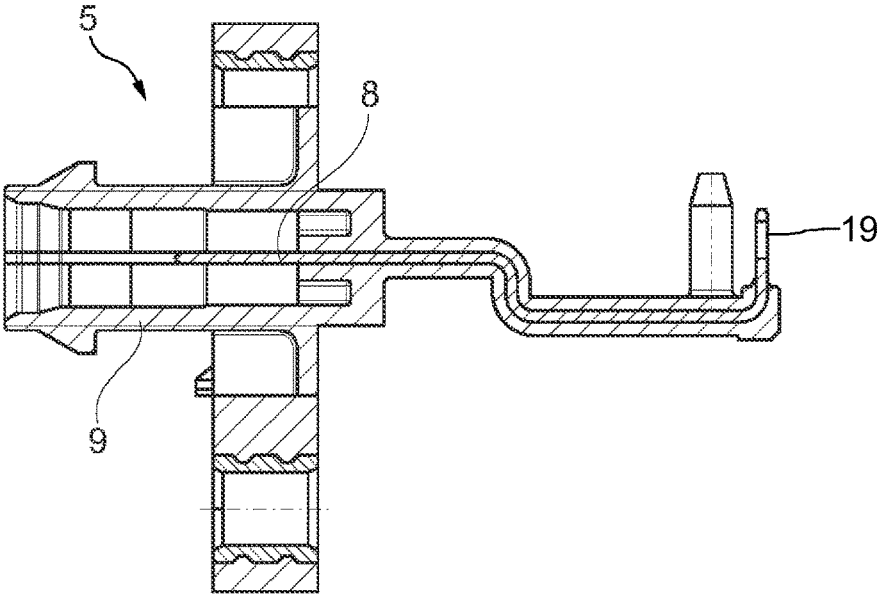
FIG. 6 is a rear view of the plug connector.
Figure 7:
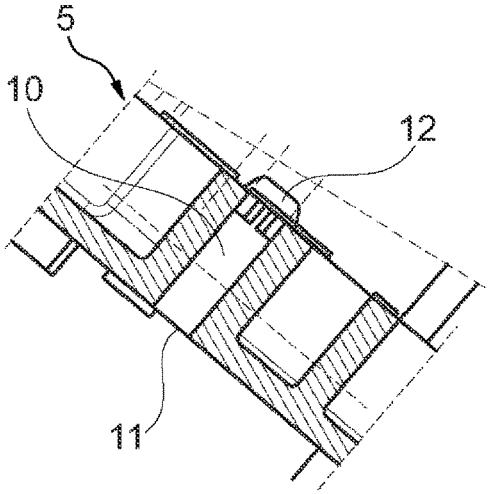
FIG. 7 is a sectional view of FIG. 5 along the section line B-B.

The housing 1 bears a plug connector 14, via which the heating resistor(s) can be connected to a voltage source, particularly a high voltage source. In addition, the housing bears a plug connector 5, via which the control electronics 6 can be connected to a voltage source. The plug connector 5 is shown in FIGS. 4 to 6. FIG. 5 shows a longitudinal section of the plug connector 5 and FIG. 7 shows a sectional view along the section line B-B of FIG. 5. The plug connector 5 has contact pins 8 which are designed at one end as press-in contacts 19 which are pressed into openings 20 on the circuit board of the control electronics 6. The plug connector 5 can be fastened to the housing 1 by means of screws 13.

A special feature of the plug connector 5 is that a vent duct 10 runs in a housing 9 of the plug connector 5 and is closed by an air-permeable membrane 11. The membrane 11 prevents the ingress of moisture, but enables pressure equalization between the interior space in which the control electronics 6 are arranged and the surroundings of the liquid heater via the vent duct 10. When the air temperature in this interior space of the liquid heater increases due to the heating resistors or waste heat from the control electronics 6, air can flow out of the interior space and a problematic pressure increase in this interior space can thus be avoided, which could stress the seal to the flow channel 15.

As shown in FIG. 7, the membrane 11 is arranged on the inner side of the plug connector 5 and thus protected from damage. At its outer end, the vent duct is covered by a cover 12. The cover 12 allows air to enter the vent duct 10 in the radial direction. The cover 12 can be designed as a separate component which projects with a section into the vent duct 10, for example, pressed into the vent duct 10.

While exemplary embodiments have been disclosed hereinabove, the present invention is not limited to the disclosed embodiments. Instead, this application is intended to cover any variations, uses, or adaptations of this disclosure using its general principles.

Further, this application is intended to cover such departures from the present disclosure as come within known or customary practice in the art to which this invention pertains and which fall within the limits of the appended claims.

LIST OF REFERENCE NUMERALS

1 housing
1*a* housing part
1*b* housing part
1*c* housing cover
2 inlet
3 outlet
4 heating plates
5 plug connector
6 control electronics
8 contact pins
9 plug connector housing
10 vent duct
11 membrane
12 cover
13 chamber
14 chamber
15 flow channel
16 air duct
18 screw

What is claimed is:

1. A liquid heater, comprising:

a housing in which a flow channel runs from an inlet to an outlet;

a heating resistor arranged within the housing and configured for heating liquid flowing through the flow channel;

control electronics arranged in an interior space of the housing, the interior space being sealed off from the flow channel; and an electrical plug connector attached to the housing;

wherein a vent duct extends through the electrical plug connector and wherein the vent duct is closed by a membrane and leads to the interior space and wherein the vent duct is covered at an outer end thereof by a cover.

2. The liquid heater according to claim 1, wherein the membrane is attached to an inner side of the plug connector facing the sealed interior space.

3. The liquid heater according to claim 1, wherein the cover allows air to enter the vent duct in a radial direction.

4. A liquid heater, comprising:

a housing in which a flow channel runs from an inlet to an outlet;

a heating resistor arranged within the housing and configured for heating liquid flowing through the flow channel;

control electronics arranged in an interior space of the housing, the interior space being sealed off from the flow channel;

an electrical plug connector attached to the housing;

wherein a vent duct extends through the electrical plug connector and wherein the vent duct is closed by a membrane and leads to the interior space and wherein the vent duct is covered at an outer end thereof by a cover; and wherein the cover has a section protruding into the vent duct.

5. The liquid heater according to claim 1, wherein the control electronics are arranged on a circuit board having openings into which press-in contacts of the plug connector engage.

6. The liquid heater according to claim 1, wherein the heating resistor is arranged together with the control electronics in the sealed interior space.

7. The liquid heater according to claim 6, wherein the sealed interior space has two chambers connected by an air duct, wherein the control electronics are arranged in one of the two chambers and the heating resistor is arranged in the other chamber.

8. The liquid heater according to claim 1, wherein the heating resistor comprises a conducting path on a substrate plate made of sheet metal coated with a dielectric.

9. The liquid heater according to claim 8, wherein an underside of the substrate plate facing away from the heating resistor defines an interior surface of the flow channel and the opposite side of the substrate plate having the conducting path disposed thereon faces the interior space which is sealed off from the flow channel.

10. The liquid heater of claim 1, wherein the plug connector includes a housing member and the vent duct extends through the housing member of the plug connector.

11. The liquid heater of claim 4, wherein the cover is a separate component and is mounted on the electrical plug connector.

* * * * *